US005113600A

United States Patent [19]

Telchuk

[11] Patent Number: 5,113,600

[45] Date of Patent: May 19, 1992

[54] COMBINATION PAINT SPRAY BOOTH-DRYING OVEN WITH SINGLE AIR FAN

[75] Inventor: Steve E. Telchuk, Buffalo Grove, Ill.

[73] Assignee: Binks Manufacturing Company, Franklin Park, Ill.

[21] Appl. No.: 407,409

[22] Filed: Sep. 14, 1989

[51] Int. Cl.[5] ..... F26B 19/00

[52] U.S. Cl. ..... 34/90; 34/218; 454/53

[58] Field of Search ..... 98/115.2; 34/202, 39, 34/218, 90; 118/642, 643

[56] References Cited

U.S. PATENT DOCUMENTS

| | | | |
|---|---|---|---|
| 2,498,339 | 2/1950 | Miskella | 118/642 |
| 3,391,630 | 7/1968 | Wilhelmsson | 98/115.2 |
| 4,416,068 | 11/1983 | Nilsson et al. | 34/39 X |
| 4,621,187 | 11/1986 | Petro, Jr. | 118/642 X |

FOREIGN PATENT DOCUMENTS

| | | | |
|---|---|---|---|
| 2710254 | 9/1977 | Fed. Rep. of Germany | 98/115.2 |
| 3542957 | 7/1986 | Fed. Rep. of Germany | 98/115.2 |

OTHER PUBLICATIONS

Specification For Paint Spray Booth R. L. Turner High School, 7 pages.

*Primary Examiner*—Henry A. Bennet
*Attorney, Agent, or Firm*—Juettner, Pyle & Lloyd

[57] ABSTRACT

A paint spray booth, which can also be utilized as a paint drying oven is disclosed and is especially suitable for use in businesses, such as automobile repair shops, to both paint and quickly bake the paint so that the number of automobiles that may be handled in a given time is increased significantly. The booth-oven comprises an enclosure which has a single air supply fan for moving air though the booth-oven. Preferably, the booth-oven has, in addition to a direct heater, a heat exchanger for more economical operation, and/or may be provided with an air recirculating system for additional savings. The booth-oven is structured so that paint laden air generated during the paint spraying operation is routed around or away from the heat exchanger.

26 Claims, 3 Drawing Sheets

COMBINATION PAINT SPRAY BOOTH-DRYING OVEN WITH SINGLE AIR FAN

DISCLOSURE

This invention relates to a combination paint spraying paint baking (or drying) oven unit, and more particularly to such a booth-oven unit which has but a single fan for moving air, heated or unheated therethrough.

BRIEF DESCRIPTION OF THE PRIOR ART

It has been known to build either a paint spray booth or a paint baking or drying oven utilizing a single fan to move air through such single function structure. But if two of such separate function structures were used together, two fans were required, one in the paint spray booth and the second in the oven. Such separate spray booth and oven were much more expensive than a combination type unit, and of course required more floor space.

While previously, combination booth-oven units have been built, they have generally been operated at ambient air pressure and have required two, expensive air moving fans and motors, one air fan to generate a higher pressure to cause air to move into the booth-oven structure, and a second air fan to generate a lower pressure to withdraw air from the booth-oven structure. Such combination booths had some form of heater to heat the painted article to bake or dry the paint, such as, for example, heat lamps or an air heater. These prior art, two-fan, booth-ovens had high initial, installation, operating and maintenance costs.

BRIEF SUMMARY OF THE PRESENT INVENTION

The combination paint spray booth-oven unit of the present invention overcomes the foregoing disadvantages and has the advantage of using only a single air moving fan. The combination paint spray booth-oven unit of the present invention comprises an enclosure which can function as a paint spray boot,, and, then subsequently, a paint drying or baking oven, air heating means for heating the air supplied to the booth-oven structure, and but a single air moving fan for moving, unheated or heated, air through the booth-oven.

Preferably, the booth-oven unit also comprises an air lock entrance or opening which permits passage of paint spraying personnel, and/or optionally the article or articles to be painted into the booth-oven without admission of excess environmental air/dust into the booth. If desired, in cases wherein the article to be painted is large, such as an automobile, a separate non-air lock opening can be provided for the booth-oven. For economy of operation the air heating means of the booth-oven of the present invention can be provided with a heat exchanger and/or recirculation to recapture the heat from the air being discharged from the oven. The booth, likewise, can be fitted with conventional air filtration, and optionally, conventional air conditioning or humidification devices. Baffle or damper means can be provided to ensure that the air supplied to the booth during spray painting is rerouted around the air heating means or heat exchanger so that it retains optimum efficiency, and these portions of the booth-oven are not subject to paint build up.

A primary object of the combination paint spray booth-oven unitary structure of the present invention is to provide but a single fan for more economical initial, installation, operating and maintenance costs.

Another object of the combination paint spray booth-oven structure of the present invention is to provide an air lock opening to permit the passage of at least paint spraying personnel.

Yet another object of the combination paint spray booth-oven of the present invention is to provide a heat recovery mechanism therefor for more economical operation.

These and other objects of the combination paint spray booth-oven of the present invention will become apparent from the following written description and the accompanying figures of the drawings.

THE PREFERRED EMBODIMENTS

Figure 1:
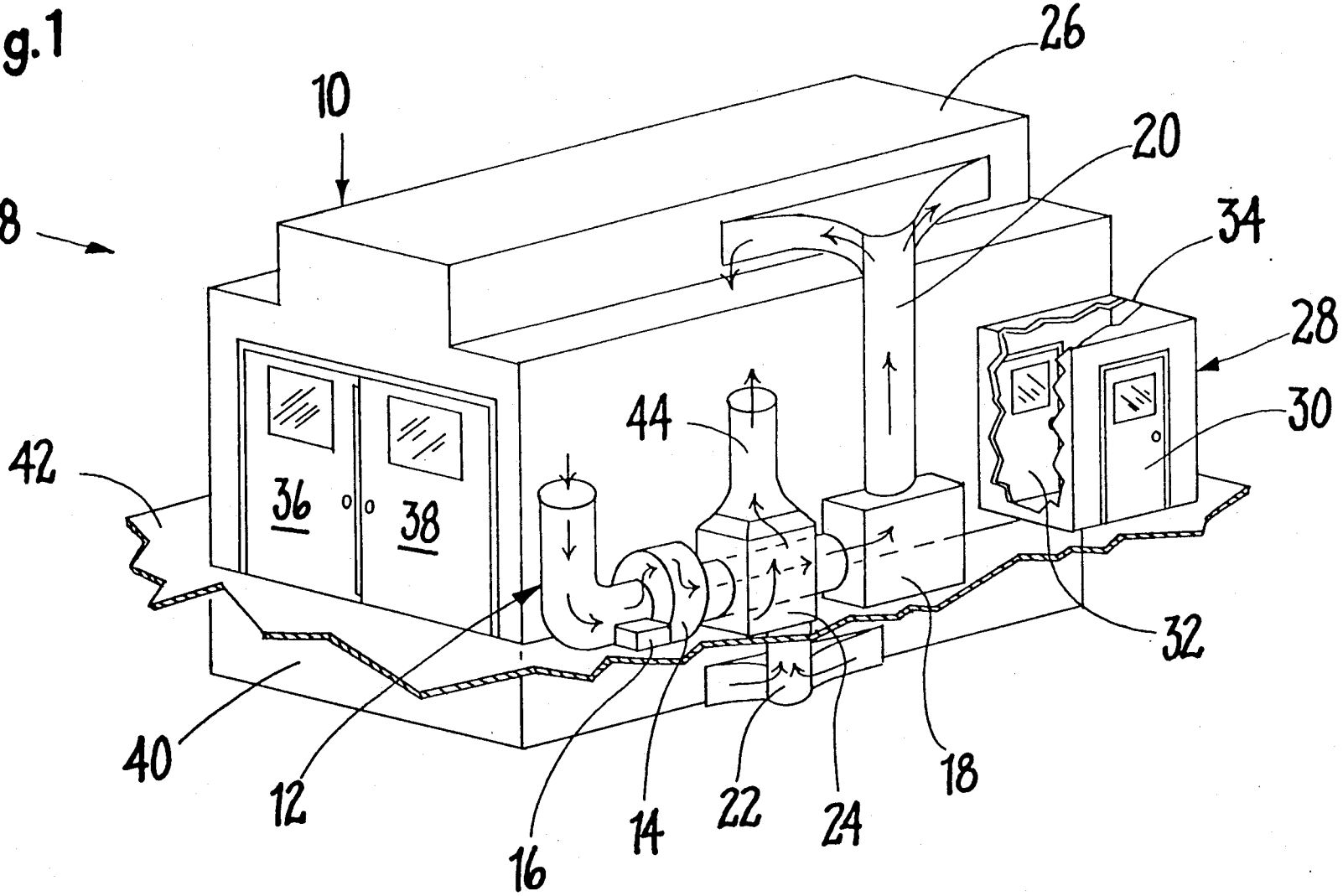
FIG. 1 is a perspective view of a first embodiment of paint spray booth-oven unit of the present invention, having a single air supply fan for forcing air into the booth-oven.

Referring to FIG. 1, a first embodiment 8 of combination paint spray booth-drying oven unit of the present invention is illustrated and comprises an enclosure 10, an inlet air supply 12, a single air moving fan 14 driven by motor 16, a heater 18, enclosure supply ducting 20, enclosure return ducting 22, and an optional heat exchanger 24.

The enclosure 10, can be of any desired size, and in this instance, is sized to accommodate the needs of, say, an auto body shop, the enclosure 10 being large enough to accommodate a vehicle, be it an automobile, bus, van, truck or trailer therefor. As is shown, the enclosure 10 is generally rectangular and has a roof structure 26 similar to that used in prior art type booths, which may also provide suitable lighting and air filtration, as in conventional.

As the enclosure 10 shown in FIG. 1 has the fan 14 arranged to provide air under at least a slight pressure, the booth is constructed, as is well known in the art, to withstand such slight pressure. As the enclosure 10, when operated, is under pressure, an air lock structure 28 has been provided on one side of the booth. Of course, it could have been provided elsewhere on the enclosure. As shown, the air lock 28 is of a conventional double door (30 and 32) construction, with an intervening enclosed space 34 therebetween. Preferably, this air lock and doorways are sized to permit the passage of spraying personnel into and out of the enclosure without a substantial loss of pressure from the enclosure or admission of a substantial amount of dirt, dust or foreign matter into the enclosure.

If the articles to be painted are large, then a separate opening for them may be provided which can be either of an air lock or non-air lock type. In the first embodiment, a pair of large doors 36 and 38 are shown at one end of the enclosure 10 and are sized large enough to permit the passage of the automobile, van or truck, etc., to be painted. If desired, other similar doors could be provided at the opposite end of the enclosure to permit drive-through operation.

The enclosure 10 sits in the floor 42 and on the inside has a grill floor of a conventional type upon which a vehicle could rest. The booth is of a conventional downdraft construction permitting air from the top of the booth to pass by the vehicle, through the grill floor into the lower portion of the booth 40 located below the building floor 42. Typically, the depth of the booth below the floor could be from 25 inches to 30 inches. If desired, the entire booth could be raised to rest on the building floor and ramps (not shown) used to raise the vehicle up to the bottom level of the doors 36 and 38.

As is shown by the arrows indicating the direction of flow, air can be taken from the inlet duct 12, raised to a somewhat higher pressure by the motor 16 driven fan 14, sent to the heater 18, which would function only during oven operation, to the booth supply duct 20, down through the enclosure 10, into the subfloor portion 40, out the return or first discharge duct 22, through one side of the heat exchanger 24 and to a second discharge duct 44 to be exhausted to the atmosphere. The heat recovered from the one side of the heat exchanger is used to preheat the air being supplied to the heater 18 by the fan 14.

Of course, during spray painting operations, the heater 18 is not on. In fact, preferably, the paint laden air coming from the the booth is by-passed around the heat exchanger 24 to prevent paint build-up on the heat exchanger surfaces. The by-pass may comprise an auxiliary duct (not shown) connecting duct 22 to duct 44 to bypass around the heat exchanger 24 and baffles or dampers located in the auxiliary duct to, in one position close the route through the heat exchanger and divert it through the auxiliary duct, and in the second position to permit flow through the heat exchanger. The baffles can be controlled by various means, such as a bimetallic strip or power operated, for example, an air motor or solenoid controlled by a temperature sensor or from a heater control circuit, or manually.

Figure 2:
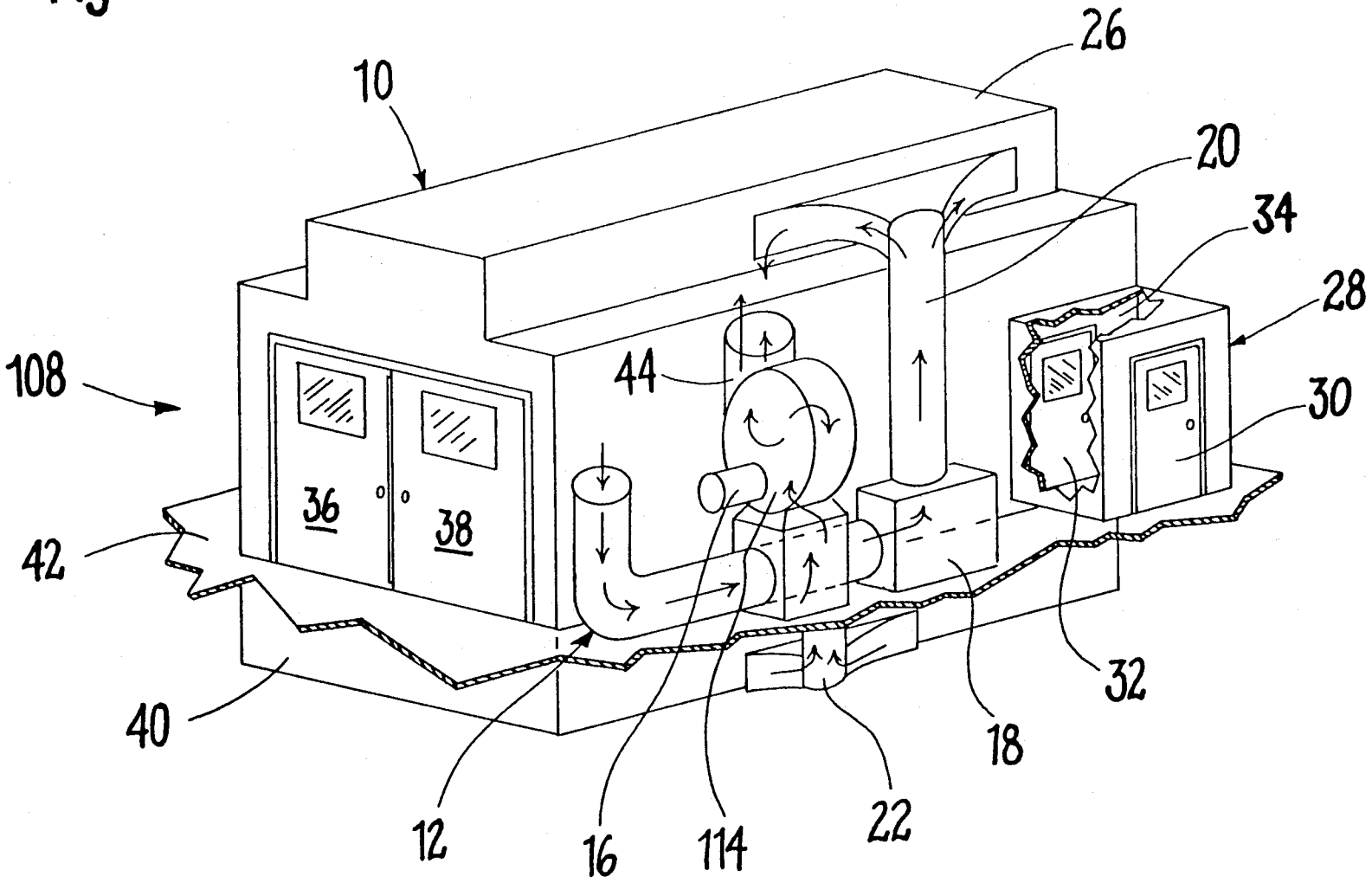
FIG. 2 is a view similar to that of FIG. 1, but showing a second embodiment wherein the single fan draws air from the booth-oven.

Referring to FIG. 2, a second embodiment of the combination booth-oven 108 is shown and is generally similar to the version shown in FIG. 1. The second embodiment differs from the first embodiment in that a fan 114 now located downstream of the enclosure and in communication wit the discharge ducts draws air from the heat exchanger, enclosure and heater, instead of forcing air into the heater, enclosure and heat exchanger. Portions of the second embodiment common to FIG. 1, are given the same reference numerals as used in FIG. 1, and only the different portions are given different reference numerals.

In the second embodiment, the enclosure is under a negative pressure, and the air lock 28 prevents entry of environmental air into the booth, should one of its doors be opened. Should it be desired, the entrance to the air lock 30 or 32, or the air lock space 34 itself, could be fitted with an automatic or manually operated air shower to blow off dust or dirt from personnel before they enter the enclosure.

Figure 3:
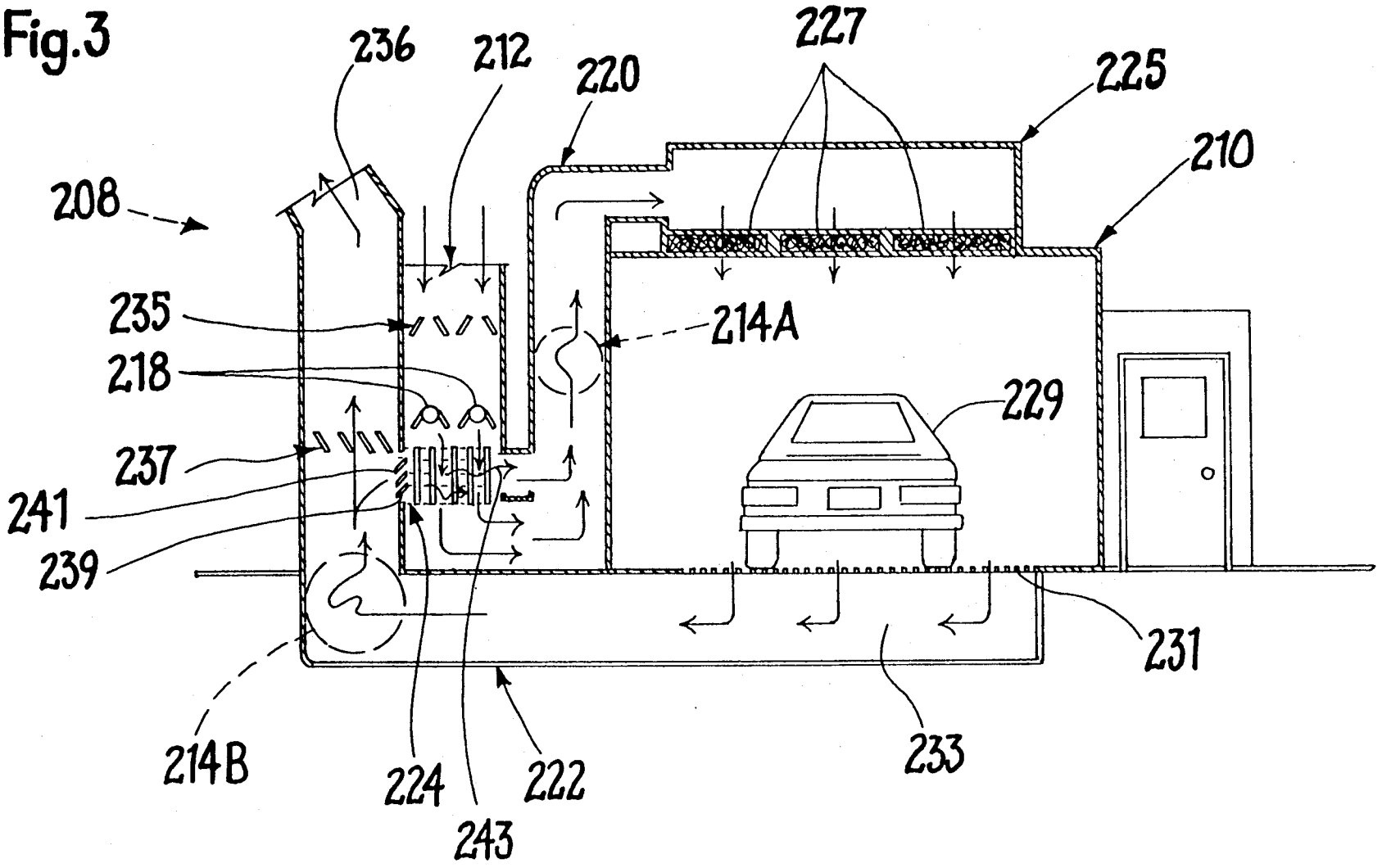
FIG. 3 is an schematic view of a third embodiment of paint spray booth-oven of the present invention.

Referring to FIG. 3, a third embodiment 208 of the spray booth-oven of the present invention is shown and comprises an enclosure 210, an inlet air supply 212, a single air moving fan, which can, for instance, be located at the position shown (by dashed lines) at 214A (blowing air into the booth oven) or 214B (exhausting air from the booth oven), a heater 218 in the form of a gas burner with accompanying controls, enclosure supply ducting 220, enclosure return ducting 222 and a heat exchanger and/or recirculation means 224.

The gas heater, in this instance in the form of burners is shown located in the inlet air supply duct 212 located just below a first set of closable dampers or baffles 235. The inlet air duct then connects to one side of the heat exchanger surface 224, and, from there, then into the supply duct 220 for the enclosure 210.

As is shown, the enclosure 210 has an upper plenum 225 which receives air from the supply ducting 220, and passes the same through, say air filters 227. The air flows down around the vehicle 229, past the grill floor 231, into the lower portion of the booth 233 and to the return ducting 222. Like booth 10, booth 210 may have an air lock and doors for vehicles.

The air from the lower portion of the enclosure is lead into the return duct 222 and may be sent out to the atmosphere, as indicated at 236. The return duct 222 is also fitted with a second set of baffles or dampers 237 which are open if the exhausted air is to be sent to the atmosphere, (the air first having been suitably cleansed of paint particulate matter as is conventional) as during spray painting, but can be closed either fully or nearly fully. This return duct 222 also is intersected by a recirculation opening 239 which in turn connects to the other side of the heat exchanger surface. At the junction of the return duct 222 and recirculation opening 239 is a third set of closeable dampers or baffles 241. This third set of dampers would be closed during paint spraying to prevent entry of paint laden air into the heat exchanger. With the second set of dampers 237 at least partially closed and the third set of dampers 241 open, as when the booth is used as an oven, the still warm air flowing through the recirculation opening 239 and other side of the heat exchanger surface are returned to the supply duct 220, as indicated at 243, to be recirculated.

As shown, the single fan could be located, for example, either in supply duct 220 (at 214A) to pressurize the enclosure 210 to a positive pressure or in the return duct (at 214B) to develop a negative pressure in the enclosure.

The operation of the third embodiment is similar to that of the first two embodiments. When paint spraying damper sets one 235 and two 237 are open and damper set three 241 is closed, the air flows past the heater or burners, which are off, into the supply duct 220 through the enclosure 210 and out the lower portion of the booth 233, the duct 222 and the stack 236 (the paint particulate having been first removed in the booth by any conventional means). Thus, no paint laden air passes through the heat exchanger.

After painting is finished, the damper sets one 212 and two 237 remain open and damper three 239 remains closed. The gas burners are turned on full to heat the air to the desired drying or baking temperature, say for example, 120° F. to 160° F. All the heated air follows the same path as just described above. Once the air reaches the desired temperature range, damper set one 212 may be nearly closed (perhaps 90% closed); the burners are cut back similarly; damper set two 237 is similarly closed (90% closed) and damper set three 241 is opened. The gas burners are then operated to just supply enough heat to keep the air in the enclosure at the desired temperature range. The heated air passes through one side of the heat exchanger and reheats the air being recirculated through on the other side of the heat exchanger. The air from the heater and from the heat exchanger then are mixed together in duct 220 and are sent back to the enclosure 210 to bake or dry the painted article. The air from the enclosure is sent to the junction of the stack 236 and recirculation opening 239, and a small amount may be exhausted (say 10%) out the stack and the remainder may be recirculated and reheated in the heat exchanger. Should the temperature drop significantly, the heater could fall back into the full heating mode previously described. When the paint is dry, the unit would cease operation, the doors opened, the painted article removed, and the booth-oven readied to receive the next article to be spray painted and then the paint dried or baked.

While a gas heater is disclosed and described, it is understood that other type heaters could also be used for example, such as electric heaters. While each damper set is composed of a plurality of dampers, other forms of damper or baffle could be used. While the preferred embodiments of the combination spray booth-oven of the present invention have been illustrated and described, from the foregoing it should be understood that variations, modifications and equivalent structures fall within the scope of the appended claims.

What is claimed is:

1. A paint spray booth-paint baking oven unit in which an article may be first paint sprayed and then the newly painted article subsequently baked, comprising a single enclosure generally isolated from the environment which functions both as a paint spray booth and subsequently as a paint baking oven, an inlet air supply for said single enclosure, a separate air heater outside of said single enclosure for heating the air supplied to said single enclosure from said inlet air supply when said single enclosure is used as a paint baking oven, and a single air moving fan for moving the air from said inlet supply through and out said enclosure when said single enclosure is used as a paint spray booth and also through said air heater when said single enclosure is used as a paint baking oven, whereby only a single fan is used to supply air to said single enclosure when it functions both as a paint spray booth and also to supply heated air when it subsequently functions as a paint baking oven.

2. A paint spray booth-paint baking oven unit as in claim 1, wherein said booth-oven operates at a pressure different from the environment and said enclosure has at least one closeable opening of an air lock construction.

3. A paint spray booth-paint baking oven unit as in claim 2, wherein said enclosure has a second closeable opening for passage of the articles to be painted and then baked.

4. A paint spray booth-paint baking oven unit as in claim 3, whereas said second closeable opening is of an air lock construction.

5. A paint spray booth-paint baking oven unit as in claim 1, wherein said single fan forces air into said enclosure.

6. A paint spray booth-paint baking oven unit as in claim 5, wherein said single fan forces air into said heater.

7. A paint spray booth-paint baking oven unit as in claim 1, wherein said single fan exhausts air from said enclosure.

8. A paint spray booth-paint baking oven unit as in claim 7, wherein said single fan exhausts air from said heater.

9. A paint spray booth-paint baking oven unit as in claim 1, wherein the air from said heater is supplied to the top of said enclosure.

10. A paint spray booth-paint baking oven unit as in claim 9, wherein the air is withdrawn from the bottom of said enclosure.

11. A paint spray booth-paint baking oven unit as in claim 1, wherein the air is withdrawn from the bottom of said enclosure.

12. A paint spray booth-paint baking oven unit as in claim 1, further comprising heat exchanger means for recovering the heat from the air being exhausted from the enclosure.

13. A paint spray booth-paint baking oven unit as in claim 12, further comprising by-pass means for routing paint laden air around said heat exchanger when the booth-oven is used for spray painting.

14. A paint spray booth-paint baking oven unit in which an article may be first paint sprayed and then the newly painted article subsequently baked, comprises an enclosure generally isolated from the environment, an inlet air supply for said enclosure, a heater for heating said enclosure, a single air moving fan for moving the air from said inlet air supply through and out said enclosure, heat exchanger means for recovering the heat from the air being exhausted from the enclosure, by-pass means for routing paint laden air around said heat exchanger when the booth-oven is used for spray painted, and automatic damper means for by-passing the heat exchanger when the booth-oven is used for spray painting, whereby only a single fan is used to supply air to said enclosure when it functions as a paint spraying booth and also when it subsequently functions as a paint baking oven.

15. A paint spray booth-paint baking oven unit as in claim 1, further comprising air filtering and conditioning means for treating the air supplied to the booth-oven.

16. A paint spray booth-paint baking oven unit as in claim 2, wherein said enclosure has a second closeable opening for passage of the articles to be painted and baked, said single fan forcing air into said heater, the air from said heater being supplied to the top of said enclosure, and the air being forced from the bottom of said enclosure.

17. A paint spray booth-paint baking oven unit as in claim 2, wherein said enclosure has a second closeable opening for passage of the articles to be painted, said single fan drawing air from said heater; the air from said heater being supplied to the top of said enclosure, and the air being withdrawn from the bottom of said enclosure.

18. A paint spray booth-paint baking oven unit in which an article may be first paint sprayed and then the newly painted article subsequently baked, comprises an enclosure generally isolated from the environment, an inlet air supply for said enclosure, a heater for heating said enclosure, a single air moving fan for moving the air from said inlet air supply through and out said enclosure, said booth-oven operating at a pressure different from the environment, said enclosure having at least one closeable opening of an air lock construction, said enclosure having a second closeable opening for passage of the articles to be painted, said single fan drawing air from said heater, the air from said heater being supplied to the top of said enclosure, the air being withdrawn from the bottom of said enclosure, a heat exchanger means for recovering the heat from the air being discharged from the enclosure, by-pass means for routing paint laden air around said heat exchanger means when the booth-oven is used for spray painting, automatic damper means for by-passing said heat exchanger means when the booth-oven is used for spray painting, and air filtering and conditioning means for treating the air supplied to the booth-oven, whereby only a single fan is used to supply air to said enclosure when it functions as a paint spraying booth and also when it subsequently functions as a paint baking oven.

19. A paint spray booth-paint baking oven unit as in claim 18, wherein said single fan forces air into said enclosure.

20. A paint spray booth-paint baking oven unit as in claim 18, wherein said single fan forces air into said heater.

21. A paint spray booth-paint baking oven unit as in claim 18, wherein said single fan draws air from said heater.

22. A paint spray booth-paint baking oven unit as in claim 18, wherein said single fan draws air from said enclosure.

23. A paint spray booth-paint baking oven unit as in claim 18, further comprising means for recirculating heated air from said enclosure back to said enclosure to assist in baking the paint.

24. A paint spray booth-paint baking oven unit as in claim 23, wherein said enclosure has an upstream duct and a downstream duct, said recirculating means comprises a recirculating duct means communicating between said downstream duct and said upstream duct of said enclosure.

25. A paint spray booth-paint baking oven unit as in claim 23, said heat exchanger means being located downstream of said heater and reheating the air from said recirculating means before it is recirculated to said enclosure.

26. In a paint spray booth-paint baking oven unit in which an article may be first paint sprayed and then the newly painted article subsequently baked, having an enclosure generally isolated from the environment, an air supply for said enclosure, and a heater for heating the air supplied to said enclosure, the improvement comprising only a single air moving fan for moving the air from said air supply through and out said enclosure, heat exchanger means for recovering the heat from the air being discharged from the enclosure, by-pass means for routing paint laden air around said heat exchanger means when the booth-oven is used for spray painting, automatic damper means for by-passing said heat exchanger means when the booth-oven is used for spray painting, and air filtering and conditioning means for treating the air supplied to the booth-oven, whereby only a single fan is used to supply air to said enclosure when it functions both as a paint spray booth and when it functions as a paint baking oven.

* * * * *